US010913083B2

(12) United States Patent
Steur

(10) Patent No.: US 10,913,083 B2
(45) Date of Patent: Feb. 9, 2021

(54) DEVICES AND METHODS FOR IMPULSE EJECTION OF A MEDIUM

(71) Applicant: Martijn Steur, Sittensen (DE)

(72) Inventor: Martijn Steur, Sittensen (DE)

( * ) Notice: Subject to any disclaimer, the term of this patent is extended or adjusted under 35 U.S.C. 154(b) by 207 days.

(21) Appl. No.: 15/565,636

(22) PCT Filed: Apr. 11, 2016

(86) PCT No.: PCT/EP2016/057922
§ 371 (c)(1),
(2) Date: Feb. 22, 2018

(87) PCT Pub. No.: WO2016/162563
PCT Pub. Date: Oct. 13, 2016

(65) Prior Publication Data

US 2018/0161792 A1 Jun. 14, 2018

(30) Foreign Application Priority Data

Apr. 10, 2015 (DE) ..... 10 2015 206 425

(51) Int. Cl.
*B05B 12/06* (2006.01)
*B01F 3/04* (2006.01)
(Continued)

(52) U.S. Cl.
CPC ..... *B05B 12/06* (2013.01); *B01F 3/04014* (2013.01); *B05B 1/083* (2013.01); *B01F 3/04836* (2013.01); *B05B 1/323* (2013.01)

(58) Field of Classification Search
CPC ..... B05B 12/06; B05B 1/083; B05B 1/323; B05B 7/1263; B05B 7/2467; B05B 7/241;
(Continued)

(56) References Cited

U.S. PATENT DOCUMENTS 5,305,957 A 4/1994 Szocs
5,664,631 A 9/1997 Szocs
(Continued)

FOREIGN PATENT DOCUMENTS

DE 19509322 A1 9/1996
EP 0402425 B1 8/1994
(Continued)

OTHER PUBLICATIONS

International Search Report and Written Opinion dated Oct. 11, 2016 for PCT/EP2016/057922 (24 pages including translation).

*Primary Examiner* — Tuongminh N Pham
(74) *Attorney, Agent, or Firm* — Seed IP Law Group LLP

(57) ABSTRACT

In order to develop devices and methods for impulse ejection of medium, a device for impulse ejection of medium is proposed, comprising a medium chamber for holding a medium, said chamber being defined by an ejection tube and a sleeve, adjoining the ejection tube at the opposite end from the ejection end thereof, and a propellant chamber) for holding a propellant, said propellant chamber surrounding at least partially the medium chamber in the region of the sleeve, wherein the sleeve is designed for movement between a pressure position and an ejection position and seals, in the pressure position, the medium chamber from the propellant chamber at an end plate and wherein the sleeve in the ejection position is spaced apart from the end plate such that there is fluid communication for passage of the propellant from the propellant chamber into the medium chamber.

10 Claims, 3 Drawing Sheets

Figure 1:
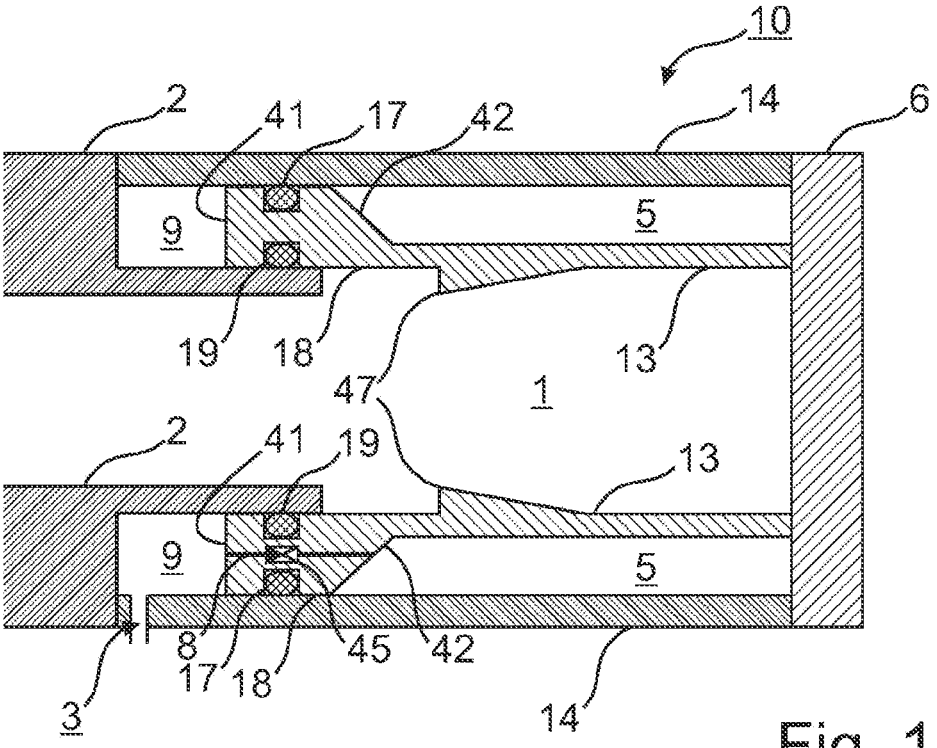

(51) Int. Cl.
*B05B 1/08* (2006.01)
*B05B 1/32* (2006.01)

(58) Field of Classification Search
CPC .. B05B 7/045; B01F 3/04014; B01F 3/04836; A62C 13/66; A62C 13/003; A62C 35/023; F41B 11/68; F41B 9/0021; F41B 9/0025; F16K 35/10
USPC ..... 169/71, 35; 124/56–77; 222/389, 44.7, 222/522; 141/384; 239/452, 322, 320
See application file for complete search history.

(56) References Cited

U.S. PATENT DOCUMENTS

| | | | | |
|---|---|---|---|---|
| 6,402,045 | B1 * | 6/2002 | Persson | B63G 13/02 239/1 |
| 9,283,576 | B2 | 3/2016 | Steur, Sr. | |
| 2004/0144012 | A1 * | 7/2004 | Adams | F41A 1/04 42/106 |

FOREIGN PATENT DOCUMENTS

| | | | |
|---|---|---|---|
| EP | 0689857 | A2 | 1/1996 |
| WO | 2009147139 | A2 | 12/2009 |

* cited by examiner

DEVICES AND METHODS FOR IMPULSE EJECTION OF A MEDIUM

BACKGROUND

Technical Field

The present invention relates to devices and methods for impulse ejection of medium.

Description of the Related Art

Devices for impulse ejection are known from EP 0 402 425 A1 and EP 0 689 857 A2, for example.

BRIEF SUMMARY

The object of the present invention is to develop the prior art solutions.

One aspect of the invention relates to a device for impulse ejection of medium, comprising a medium chamber for holding a medium, said chamber being defined by an ejection tube and a sleeve, adjoining the ejection tube at the opposite end from the ejection end thereof, and a propellant chamber for holding a propellant, said propellant chamber surrounding at least partially the medium chamber in the region of the sleeve, wherein the sleeve is designed for movement between a pressure position and an ejection position and seals, in the pressure position, the medium chamber from the propellant chamber at an end plate and wherein the sleeve in the ejection position is spaced apart from the end plate such that there is fluid communication for passage of the propellant from the propellant chamber into the medium chamber.

Another aspect of the invention relates to a method for impulse ejection of medium, comprising the steps of filling a medium chamber of a device for impulse ejection with medium, wherein the medium chamber is defined by an ejection tube and a sleeve adjoining the ejection tube at the opposite end from the ejection end thereof, and filling a propellant chamber of the device with pressurized propellant, said propellant chamber surrounding at least partially the medium chamber in the region of the sleeve, wherein the sleeve, after the filling steps, is held in a pressure position in which the sleeve seals the medium chamber with an end plate against the propellant chamber, wherein the sleeve, in a following release step, is released for movement from the pressure position to an ejection position in which the sleeve is moved by the pressurized propellant in such a way that, as a result of said movement, the sleeve is spaced apart from the end plate and fluid communication is formed for the passage of propellant out of the propellant chamber into the medium chamber, wherein the propellant ejects the medium in an impulse-like manner through the ejection end in an impulse step.

These aspects of the invention are based on the realization that the pressurized propellant itself can be used as a means for opening a "closure" separating the propellant from the medium, and that such opening is not limited to the propellant and the "closure" moving in the same direction. Although the propellant drives the sleeve in the direction of the ejection end in the present invention, such that fluid communication is formed or released, impulse ejection itself is brought about by propellant that expands in the opposite direction. The device according to the invention allows the propellant chamber to be provided around the medium chamber in such a way that a more compact construction is possible compared to a prior art device for impulse ejection in which the medium chamber and the propellant chamber are arranged one behind the other.

It has also been found that, compared to prior art devices for impulse ejection, the invention produces less recoil for the same impulse power, which is particularly interesting in the case of a hand-held device. If the same recoil is accepted, it is possible with the device and method according to the invention for a larger volume of medium to be ejected.

In one embodiment of the invention, the sleeve has a collar region which surrounds a region of the ejection tube. Due to the sleeve and the ejection tube overlapping in the collar region, a coupling and a connection are formed between the sleeve and the ejection tube, which can be movably sealed by a sliding seal, for example, or similar.

In one variant of the embodiment, the collar region is arranged between the propellant chamber and a pressure chamber, the pressure chamber being designed to hold a pressurized fluid, such that the sleeve is pressed against the end plate by the pressure in the pressure chamber. The pressurized fluid (gas and/or liquid) in the pressure chamber presses the sleeve away from the ejection end and towards the end plate. The pressure of the fluid thus ensures that the sleeve and the end plate have a sealing effect.

In one advantageous development of the configuration, the collar region has a first end face facing the pressure chamber and a second end face which is smaller than the first end face and which faces the propellant chamber. When the pressure chamber and the propellant chamber are under equal pressures, the difference between the end faces results in a force which presses the sleeve against the end plate. The pressure can be built up jointly in the pressure chamber and the propellant chamber. It is possible, in particular, to fill both the propellant chamber and the pressure chamber with the pressurized propellant. With an appropriate difference between the end faces, however, the pressure in the pressure chamber can even be lower than that in the propellant chamber, without the resultant force failing to materialize. Even if the end face facing the propellant chamber is larger than the end face facing the pressure chamber, the resultant force that is desired (which presses the sleeve onto the end plate) can be achieved if the fluid in the pressure chamber has a sufficiently higher pressure than the propellant in the propellant chamber.

In another development of the invention, the collar region is provided with at least one non-return valve designed for passage of propellant from the pressure chamber to the propellant chamber. The non-return valve allows propellant to be channeled into the pressure chamber first of all, and to flow from there into the propellant chamber, without a drop in pressure in the pressure chamber resulting in a drop in pressure in the propellant chamber.

In one variant of the invention, the sleeve has a shoulder on its inner side near the collar region, where an inner cross-section of the sleeve is substantially equal to an inner cross-section of the ejection tube. It has been found that the matching inner cross-sections (i.e. the inner walls are in alignment with each other) are advantageous for impulse ejection, possibly due to the avoidance of turbulence.

In one embodiment of the invention, the shoulder is formed by a projection, and the inner cross-section of the sleeve widens towards the end plate in part of the sleeve. A preferably continuous transition to a wider inner cross-section has been found to have no disadvantageous effect on impulse ejection, whereas it is possible with the larger inner cross-section for the medium chamber to have a larger volume, without the device itself having to be longer in design.

In another variant, the sleeve can be provided with guide members so that any relative rotation of the sleeve inside the casing pipe, for example, or relative to the ejection tube, can be prevented.

It is possible for the pressure chamber and the propellant chamber to be pressurized separately, regardless of whether there is (limited or one-sided) fluid communication between the pressure chamber and the propellant chamber.

The force resulting from the pressure difference is preferably used, in the context of the invention, to press the sleeve against the end plate. Instead of or in addition to a force resulting from different pressures and/or end faces, it is also possible to provide some other acting force or biasing force, for example with a suitable spring (preferably in the pressure chamber) or by means of magnets which are arranged to exert either an attracting force (e.g., in the sleeve and the end plate) or a repellent force (e.g., in the pressure chamber, medium chamber or the casing pipe, on the one hand, and in or on the sleeve, on the other hand).

Release is preferably the result of a rapid drop in pressure in the pressure chamber, such that the pressure in the propellant chamber takes the sleeve away from the end plate. The invention is not limited to these examples, and other kinds of release can also be used, including a mechanical locking mechanism which is unlocked to provide release.

It is not absolutely essential that the gap between the sleeve and the casing pipe is (completely) sealed, as along as the passage of propellant is limited or hindered to such an extent that no significant amount of propellant is "blown off" through that gap during impulse ejection. It is quite possible, on the contrary, to use the annular gap between the sleeve and the casing pipe as an intentional fluid connection between the propellant chamber and the pressure chamber, so that both can be filled with pressurized propellant. In that case (and also in other variants), propellant can be supplied via the propellant chamber, from where it then passes into the pressure chamber. In such a case, it is sufficient for sleeve release controlled by a drop in pressure that the pressure chamber is provided with a discharge port, which does not necessarily have to be designed also for the supply of propellant or other fluid.

One way of developing the seal between the sleeve and the casing pipe, if such a seal is provided in the first place, is to design the seal with a backpressure valve function, such that propellant supplied to the pressure chamber can pass through that seal or past it into the propellant chamber, in order to build up pressure there, but not in the opposite direction from the propellant chamber into the pressure chamber (which is not pressurized on release).

A seal provided between the sleeve and the ejection tube is not limited to abutting, for example in the form of an O-ring, against the outer surface of the ejection tube and the inner surface of the sleeve. Another way of developing the seal, for example, is to provide a bellows or the like between the sleeve and the ejection tube so as to connect them.

If the sleeve is released by reducing the pressure in the pressure chamber, then this depressurization can be designed so that the pressure chamber is not completely depressurized (e.g., by retaining an opening to the surroundings), but rather that a defined amount of fluid remains in the pressure chamber and acts as a buffer which exercises a braking effect on the sleeve, especially when the fluid is a gas, in order to prevent or at least mitigate any impact of the sleeve against the ejection tube, for example.

The device according to the invention is preferably designed for hand-held (preferably completely mobile) use, although the invention can also be realized in a device which is supported on a vehicle or fixedly mounted.

The ejection tube, the sleeve and the casing pipe preferably have a round (circular) cross section, although other shapes are likewise possible, including asymmetric shapes.

Another aspect of the invention relates to a device for impulse ejection of medium, comprising a device body having a medium chamber for holding medium, said medium chamber being defined at least in part by an ejection tube, and a propellant chamber for holding a propellant for impulse-like expulsion of the medium through an ejection end of the ejection tube, a release handle attached to the device body, for holding the device with one hand of the user and for triggering the impulse ejection, and a grip attached to the device body for holding the device with the other hand of the user, wherein the grip and/or the release handle are designed to rotate about an axis parallel to the direction of impulse ejection.

This aspect can be advantageously combined with the embodiments above.

In the case of a hand-held device for impulse ejection, and one that has a certain size or greater, it is generally necessary to hold the device securely with two hands, due to the recoil that occurs on impulse ejection. It has been found that regardless of whether the user is right-handed or left-handed, different users have different preferences regarding how the release handle and the grip are positioned relative to each other. When a suitable way of adjusting this relative positioning was provided, it was found that the holding and handling of the device could be improved. The device for impulse ejection is generally held at the hip, so its handling cannot be compared with the handling of a rifle, for example, which is generally held against the shoulder in order to aim.

In one embodiment of this aspect of the invention, the device has a shutoff valve for a supply line for supplying medium to the medium chamber, wherein the grip is designed to be moved along the ejection tube between an open position and a closed position, wherein the grip is coupled to the shutoff valve in such a way that the shutoff valve is opened by moving the grip into the open position, to allow medium to pass through, and the shutoff valve can be closed by moving the grip into the closed position. In this embodiment, the medium can be supplied to the medium chamber without the hands having to be taken off the grip and the release handle. If the user has to take one of his hands off the grip or the handle in order to control the shutoff valve, the user might forget to hold onto the grip or handle again before triggering the impulse ejection. Due to the recoil, this can result in an uncontrolled reaction ("bucking") on the part of the device, which is associated, in particular, with a risk of injury to the user.

In one development of the invention, the rotatable grip or handle is fitted with a fixing device which allows the grip or handle to be selectively fixed or released for rotation. By fixing the grip or handle, the user can set an adjusted rotating position as the desired position.

The rotating grip can be provided with a guide means which limits the rotation to certain ranges. For example, it is possible with a guide means in the shape of a T-slot or with a V-shaped opening to prohibit rotation in the region towards the release handle or to allow rotation to only a restricted extent.

The device according to the invention preferably has one or more stops for the rotatable grip, which limit rotation, although totally free rotation is not precluded for the grip, at least.

BRIEF DESCRIPTION OF THE SEVERAL VIEWS OF THE DRAWINGS2

Figure 2:
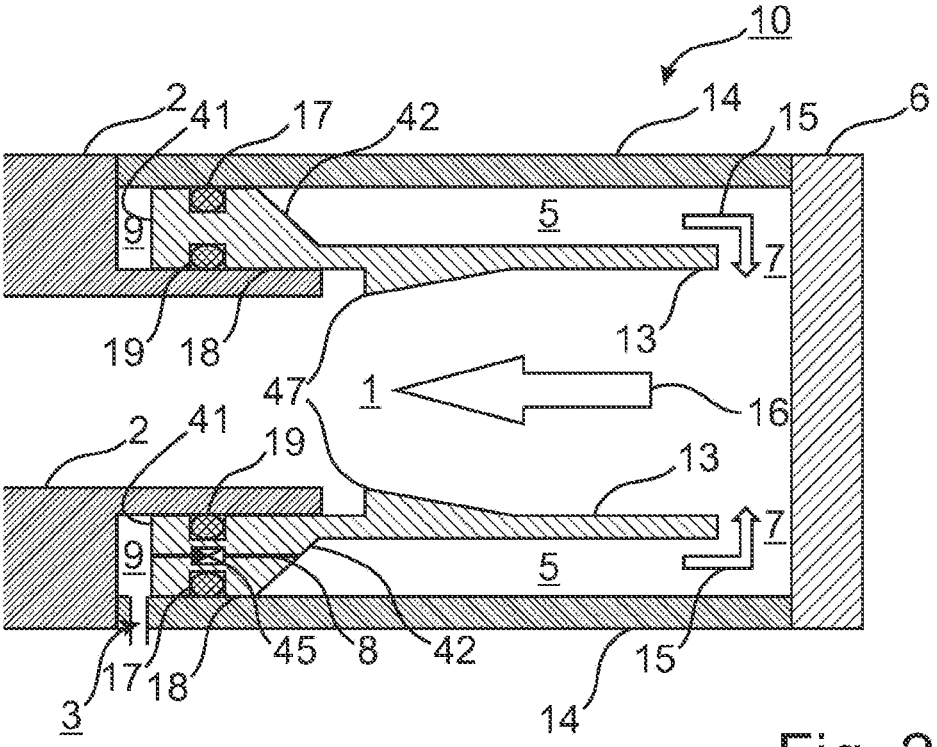
Figure 3:
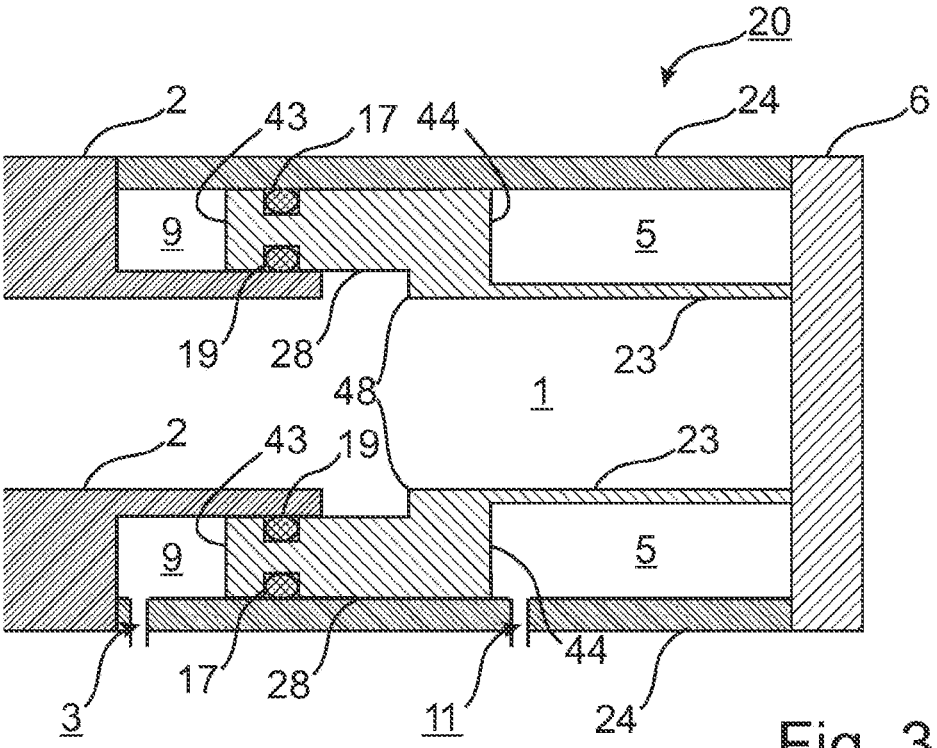
Figure 4:
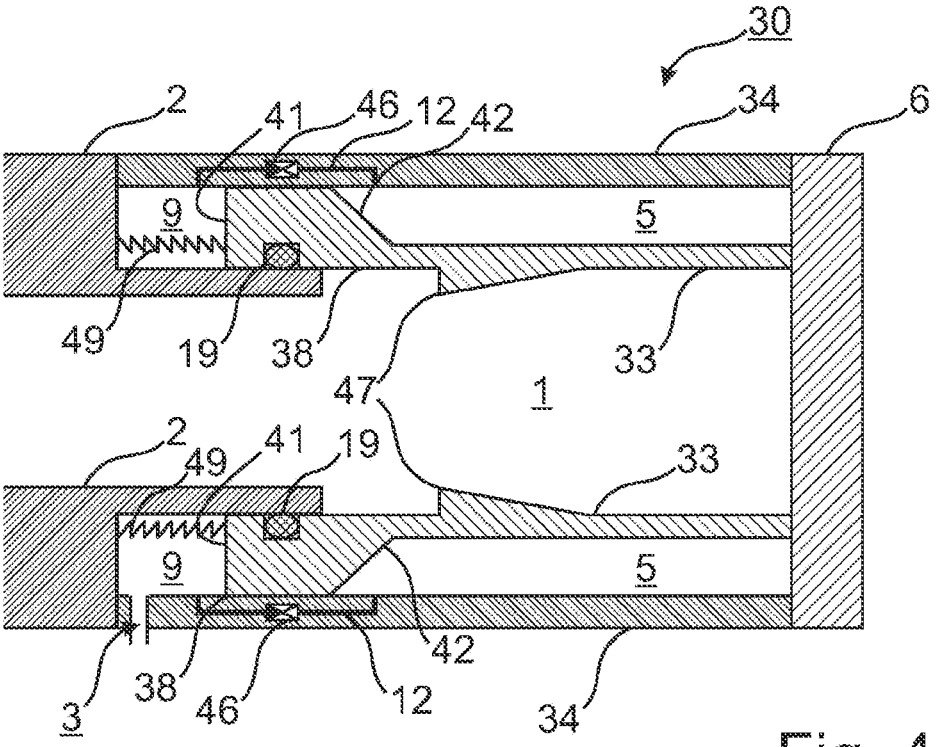
Figure 5:
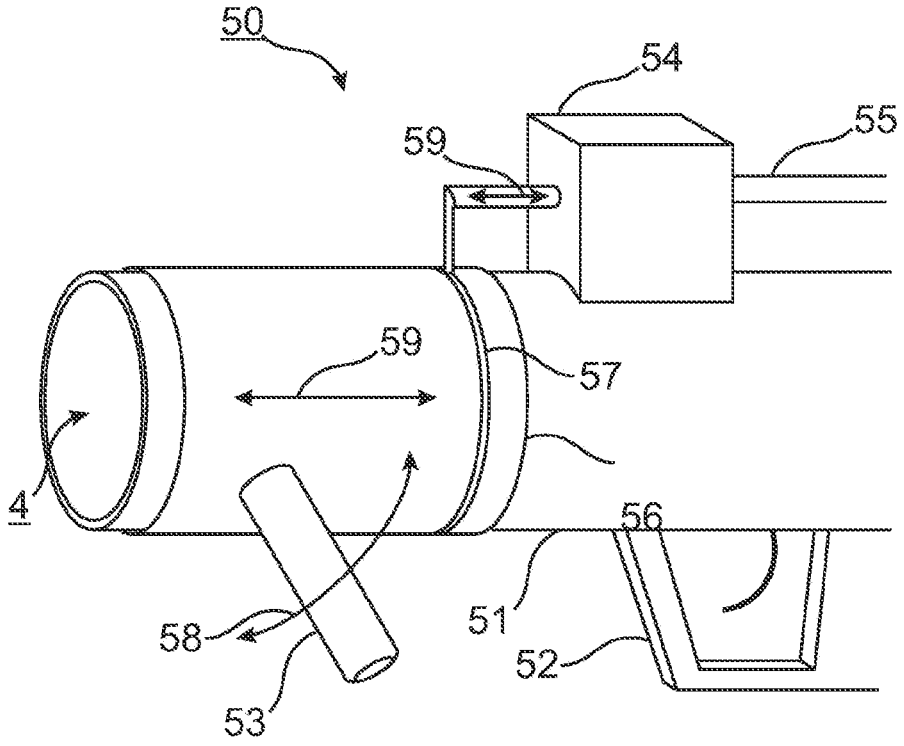
Figure 6:
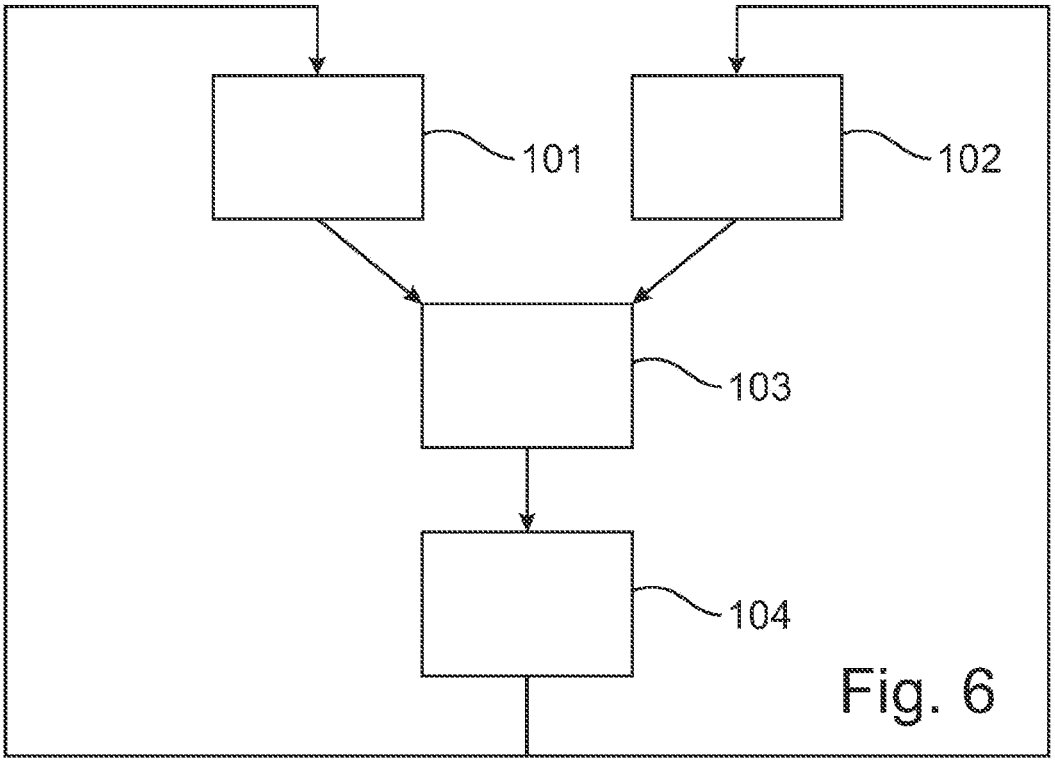

In the following, the present invention shall be illustrated and described with reference to the embodiments shown in the Figures, in which in which FIG. 1 shows a schematic illustration of a first embodiment of the inventive device for impulse ejection of a medium in a state before ejection, FIG. 2 shows a schematic illustration of a first embodiment of the inventive device for impulse ejection of a medium in a state during ejection, FIG. 3 shows a schematic illustration of a second embodiment of the inventive device for impulse ejection of a medium in a state before ejection, comparable to the illustration in FIG. 1, FIG. 4 shows a schematic illustration of a third embodiment of the inventive device for impulse ejection of medium in a state before ejection, comparable to the illustration in FIG. 1 or FIG. 3, FIG. 5 shows a schematic perspective view of an embodiment of the inventive device for impulse ejection of medium and FIG. 6 shows a schematic flow diagram of a method according to the invention for impulse ejection of medium.

FIG. 1 shows a schematic illustration of a first embodiment of inventive device 10 for impulse ejection of a medium in a state before ejection.

DETAILED DESCRIPTION

Device 10 for impulse ejection has a medium chamber 1, which serves to hold a medium. The medium can be a fluid, for example (e.g., water, possibly mixed with additives or the like). Another possibility is to provide particles that are suitable as a medium and have a sufficiently small particle size. Since the invention does not necessarily differ in respect of the medium from prior art solutions for impulse ejection, any further discussion of the medium can be dispensed with here, because a person skilled in the art will be sufficiently familiar with the properties and the requirements to be met with regard to impulse-ejected media.

Medium chamber 1 is bounded by an ejection tube 2, wherein said ejection tube 2 may itself be open in the ejection direction (to the left in the view shown in FIG. 1) at its ejection end (not shown in FIG. 1; see FIG. 5) or may be sealed by a known membrane or similar to prevent inadvertent escape of medium.

Ejection tube 2 is adjoined, on the side facing away from the ejection end (i.e. to the right in FIG. 1), by a sleeve 13 which likewise surrounds medium chamber 1. Medium chamber 1 and sleeve 3 extend as far as an end plate 6, against which sleeve 3 sealingly abuts in the state shown in FIG. 1.

The medium chamber thus extends from end plate 6 through sleeve 3 and ejection tube 2 as far as the ejection end of ejection tube 2 or as far as some other closure region of ejection tube 2 (not shown in FIG. 1). It should be noted in this regard that medium chamber 1 does not necessarily have to be completely filled with medium before ejection. Medium can be ejected as long as there is a sufficient amount and distribution of the medium to prevent "blow-off" of the propellant (see below). However, that also holds true for conventional devices for impulse ejection of a medium.

Sleeve 13, in combination with end plate 6 and a casing pipe 14 which accommodates sleeve 13, surrounds a propellant chamber 5. In the state shown in FIG. 1, there is no fluid communication between propellant chamber 5 and medium chamber 1, because sleeve 13 sealingly abuts end plate 6.

Sleeve 13 widens at its end or collar region 18 towards the ejection end (i.e. to the left in FIG. 1), in such a way that in one section it substantially fills the region between an outer surface of ejection tube 2 and an inner surface of casing pipe 14. This widening gives the sleeve an end face 42 facing propellant chamber 5 and matching the cross-section of propellant chamber 5.

In this region, sleeve 13 is fitted with a seal 17 between sleeve 13 and casing pipe 14 in order to provide additional sealing against the passage of propellant.

On the side of the sleeve facing away from propellant chamber 5 (i.e. facing towards the ejection end), ejection tube 2, casing pipe 14 and sleeve 13 enclose a pressure chamber 9. Sleeve 13 has an end face 41 facing pressure chamber 9, which matches the cross-section of pressure chamber 9. A seal 19 between sleeve 13 and ejection tube 2 seals against escape of the propellant (see below) from pressure chamber 9 into medium chamber 1.

Sleeve 13 is mobile, relative to ejection tube 2, along a middle or longitudinal axis of ejection tube 2, so the size of pressure chamber 9 is variable. Movement of sleeve 13 relative to ejection tube 2 is limited by end plate 6 and by ejection tube 2.

At a distance from the end of ejection tube 2, sleeve 13 has a inner circumferential shoulder 47 which is designed in such a way that the free cross-section (or inner cross-section) of shoulder 47 matches the free cross-section of ejection tube 2. It is not necessary here that shoulder 47 contacts or impacts the end of ejection tube 2 whenever sleeve 13 moves (see FIG. 2), although this is not precluded. In the embodiment shown in FIG. 1, the inner wall of sleeve 13 and the inner wall of ejection tube 2 would be flush with each other in the event of such contact. Shoulder 47 is embodied as a projection such that the free cross-section of the sleeve widens towards the ejection end. In the present embodiment, this widening is such that the inner cross-section before and after the projection is identical, although not required.

Casing pipe 14 has a supply line 3 to pressure chamber 9, through which pressure chamber 9 can be provided with a pressurized propellant 9.

If pressurized propellant is introduced into pressure chamber 9, the pressure which is thus produced in pressure chamber 9, and which also acts on end face 41 of sleeve 13, ensures that sleeve 13 is pressed against end plate 6.

In the present embodiment, sleeve 13 has a passage 8 through its collar region 18. Passage 8 provides fluid communication between pressure chamber 9 and propellant chamber 5 and includes a non-return valve 45 which only allows passage from pressure chamber 9 to propellant chamber 5, but blocks any passage in the opposite direction. Only one such passage 8 is shown in FIG. 1, but the device according to the invention may well have a plurality of such passages 8 disposed around the circumference of sleeve 13 and having non-return valves 45.

When pressure chamber 9 is filled with propellant and under pressure, propellant will therefore pass through passage 8, such that the pressure in pressure chamber 9 is substantially adjusted to the pressure in propellant chamber 5. Even when the propellant exerts pressure in propellant chamber 5, there is still a resultant force acting on sleeve 13, because end face 41 is larger than end face 42. Since only the force acting in the longitudinal direction is relevant in this regard, the slope of sleeve 13 in collar region 18 is of no relevance.

To prepare an impulse ejection, medium chamber 1 is filled with medium and a desired pressure of the propellant (fluid, preferably gas, for example air) is built up in pressure chamber 9 and propellant chamber 5.

When the pressure of the propellant in pressure chamber 9 decreases (preferably abruptly), the pressure of the propellant that still exists in propellant chamber 5 then drives sleeve 13 towards ejection tube 2 (to the left in FIG. 1), with the result that sleeve 13 is spaced apart from end plate 6 and fluid communication is thus formed (see FIG. 2) between propellant chamber 5 and medium chamber 1.

The state of sleeve 13 after it has moved relative to the state shown in FIG. 1 is shown in FIG. 2, which shows a schematic illustration of a first embodiment of the inventive device 10 for impulse ejection of a medium in an ejection state.

The pressurized propellant flows through fluid connection 7 between end plate 6 and sleeve 13 which has moved away therefrom, as indicated by arrow 15. The expanding propellant drives out the medium in medium chamber 1, thus resulting in impulse ejection of the medium out of medium chamber 1 through sleeve 13 and ejection tube 2, as indicated by arrow 16.

FIG. 3 shows a schematic illustration of a second embodiment of inventive device 20 for impulse ejection of a medium in a state before ejection, comparable to the illustration in FIG. 1.

The basic structure of the device 20 shown in FIG. 3 is the same as that of device 10 shown in FIGS. 1 and 2. Corresponding elements are thus marked with identical reference signs. Unless stated otherwise in the following, the statements made with reference to FIGS. 1 and 2 above also apply accordingly to the second embodiment.

The second embodiment differs from the first embodiment of the inventive device by having a different design of sleeve 23, first of all. In collar region 28 adjoining the region between ejection tube 2 and a casing pipe 24, sleeve 23 has a shoulder 48 where the inner cross-section of sleeve 23 decreases in one step from a region which surrounds ejection tube 2 and is substantially outside ejection tube 2, to an inner cross-section matching that of ejection tube 2. Unlike in the first embodiment, the inner cross-section of sleeve 23 does not widen towards end plate 6, but remains constant.

Sleeve 23 has an end face 43 facing pressure chamber 9 and another end face 44 facing propellant chamber 5. However, in the second embodiment, end face 44 is larger than end face 43, in contrast to the case of the first embodiment shown in FIGS. 1 and 2.

As in the first embodiment also, casing pipe 24 has a supply line 3 to pressure chamber 9, through which the inside of pressure chamber 9 can be pressurized. In addition to that, casing pipe 24 (unlike casing pipe 14 above) includes an additional supply line 11 to propellant chamber 5, through which propellant chamber 5 can be supplied with pressurized propellant separately from the pressure chamber.

Sleeve 23 accordingly has no passage providing fluid communication between pressure chamber 9 and propellant chamber 5.

Since the pressure in pressure chamber 9 and in propellant chamber 5 can thus be adjusted independently of one another, it is possible, by setting a higher pressure in pressure chamber 9 relative to the pressure in propellant chamber 5, to produce a resultant force that presses sleeve 23 against the end plate even when cross-section 44 is greater than cross-section 43.

Like in the first embodiment, a pressure drop in pressure chamber 9 causes this resultant force to be reversed, given the pressure remaining in propellant chamber 5, with the result that sleeve 23 is moved towards the ejection end, thus allowing fluid communication between propellant chamber 5 and medium chamber 1.

FIG. 4 shows a schematic illustration of a third embodiment of the inventive device for impulse ejection of medium in a state before ejection, comparable to the illustration in FIG. 1 or FIG. 3.

The basic structure of the device 30 shown in FIG. 4 is the same as that of device 10 shown in FIGS. 1 and 2. Corresponding elements are thus marked with identical reference signs. Unless stated otherwise in the following, the statements made with reference to FIGS. 1 and 2 above also apply accordingly to the third embodiment.

Sleeve 33 of the third embodiment largely corresponds in its basic form to sleeve 13 of the first embodiment. Unlike the latter, sleeve 33 has a seal 19 on its inner side only, as a seal between sleeve 33 and ejection tube 2, but not on its outer side, which is flush with a casing pipe 34. Due solely to sleeve 33 being in contact with the inner wall of casing pipe 34, there is a certain amount of fluidic resistance against propellant flowing between pressure chamber 9 and propellant chamber 5. Similarly to the second embodiment, sleeve 33 itself does not have a passage leading from pressure chamber 9 to propellant chamber 5.

Like casing pipes 14 and 24 of the first and second embodiment, casing pipe 34 has a supply line 3 to pressure chamber 9. In contrast to casing pipes 14 and 24 in the other embodiments, casing pipe 34 itself has two passages 12, each provided with a non-return valve 46, which allow pressurized propellant to flow from pressure chamber 9 to propellant chamber 5, but block such flow in the opposite direction.

Two passages 12 each provided with a non-return valve 46 are shown in FIG. 4, although it is also possible for design reasons to provide one passage 12 or even multiple passages 12. If need be, one or more passages through the sleeve, as described in the first embodiment above, may also be provided in addition.

Besides passages 12, the collar region 38 of sleeve 33 also allows propellant to pass, due to the absence of a proper seal between sleeve 33 and casing pipe 34. It is also possible to modify the present third embodiment by providing a seal between the sleeve and the casing pipe, as in the first and second embodiments.

However, for the invention to work, it makes no difference that pressurized propellant can pass from propellant chamber 5 to pressure chamber 9 when the fluidic resistance for flow between sleeve 33 and casing pipe 34 is so great that any pressure drop during the relevant impulse ejection period is not too great. If designed accordingly, passage through the annular gap between the sleeve and the casing pipe can also be used to one and only fluid connection between the pressure chamber and the propellant chamber, without any additional passageways (with or without non-return valve) being needed.

In addition to the design of the first embodiment, the third embodiment has one or more springs 49 which bias sleeve 33 against end plate 6 even without the propellant exerting pressure. With the aid of such a biasing force independent of any pressure being exerted (and which can also be produced in other ways), the sleeve is prevented from adopting an indeterminate position when no pressure is exerted (yet) by the propellant. The biasing force is set so that it plays an insignificant role, at most, compared to the pressure exerted by the propellant on end face 42 when impulse ejection is triggered.

The device according to the invention, as discussed above by way of example with reference to embodiments, may provide automatic closure of said obturator—insofar as an obturator, for example a shutoff valve or similar, is provided for filling the medium chamber with medium—, for example so as not to exceed a desired filling level, regardless of how the device is operated by a user, and/or to prevent undesired filling of the medium chamber, as a safety aspect. It is possible in this regard to couple triggering of the impulse ejection to prior closure, or vice versa, to couple closure to triggering (e.g., in the sense that, after impulse ejection, a supply of medium is prevented until the operator allows it).

FIG. 5 shows a schematic perspective view of an embodiment of the inventive device 50 for impulse ejection of medium.

Device 50 for impulse ejection comprises a device body 51. Said device body 51 has a medium chamber (not shown, see FIGS. 1 to 4, for example) for holding medium. Similarly to what was discussed in connection with the embodiments above, the medium chamber is defined at least in part by an ejection tube (not shown, see FIGS. 1 to 4, for example). The device body also has a propellant chamber (not shown, see FIGS. 1 to 4, for example), in which propellant for impulse-like expulsion of the medium can be kept.

Device 50 includes a release handle 52 which is attached to device body 51 and which is used, similarly to conventional hand-held devices for impulse ejection, for holding device 50 with one hand of the user and for triggering the impulse ejection.

As already known from conventional hand-held devices, device 50 has a grip 53 for holding device 50 with the other hand of the user.

Device 50 according to this embodiment is characterized in that grip 53 is designed to rotate about a longitudinal axis of device 50 (or of the ejection tube), as indicated by double-headed arrow 58. This rotation allows grip 53 to be rotated by 90°, for example, from a plane defined by the release handle and the longitudinal axis of the device (i.e., the plane of the drawing in FIG. 5), in order to adjust device 50 to the wishes of the respective user, who may be left- or right-handed.

Alternatively or in addition thereto, release handle 52 can also be designed so that it rotates.

In this embodiment, grip 53 is not used to hold device 50, but also to operate a shutoff valve 54 of device 50. The shutoff valve opens and closes a supply line 55 for medium to medium chamber 1 of the device. Grip 53 is designed to be moved along the ejection tube (between ejection end 4 and release handle 52), between an open position and a closed position and is coupled to shutoff valve 54 in such a way that shutoff valve 54 is opened by moving grip 53 into the open position, to allow medium to pass through, and shutoff valve 54 can be closed by moving grip 53 into the closed position. This movement is indicated by double-headed arrow 59.

Device 50 has a casing 56 which is movably mounted on device body 51. Said casing 56 has a groove 57 with which a transfer mechanism coupled to shutoff valve 54 engages, so that the longitudinal movement is transferred independently of the rotational state of grip 53.

Shutoff valve 54 may also be designed in such a way (not shown here), also when shutoff valve 54 is operated using grip 53 as described above, that any further passage of medium is prevented, for example when a predefined filling level is reached. Such blocking which temporarily disables operation by grip 53 may also be linked to triggering the impulse ejection, with the passage of medium being stopped so as to prevent any undesired and immediate filling with medium—e.g., until grip 53 has again been moved back and forth.

One possible alternative is to provide a safety mechanism such that impulse ejection cannot be triggered until grip 53 is in an appropriate position (which closes the shutoff valve).

FIG. 6 shows a schematic flow diagram of a method according to the invention for impulse ejection of medium.

In a filling step 101, a medium chamber of a device for impulse ejection is filled with medium. With regard to the details of the device for impulse ejection, reference is made to the embodiments shown in FIGS. 1 to 4.

In a parallel filling step 102, a propellant chamber of the device is filled with pressurized propellant.

After filling steps 101, 102, a sleeve of the device, which partly surrounds the medium chamber, is held in a pressure position in which the sleeve seals the medium chamber against the propellant chamber.

Depending on the details of the device for impulse ejection, either the propellant chamber or the medium chamber is initially filled, followed by further respective filling. It is likewise possible to perform steps 101 and 102 at least partially parallel and simultaneously with each other.

In a following release step 103, the sleeve is released for movement from the pressure position to an ejection position. When this movement is performed, the sleeve is moved by the pressurized propellant such that, as a result of said movement, the sleeve is spaced apart from an end plate, against which it abutted to form a seal between the medium chamber and propellant chamber, so that fluid communication is formed for the passage of propellant out of the propellant chamber and into the medium chamber.

Due to this fluid communication, the pressurized propellant passes through in an impulse step 104 and propels the medium ahead of it, with the result that the medium is ejected in an impulse-like manner from an ejection end of the device.

The invention claimed is:

1. A device for impulse ejection of a medium, comprising:

a housing;

an end plate that is fixed relative to the housing;

an ejection tube;

a medium chamber for holding the medium, the medium chamber being defined by a sleeve and including an ejection end, the sleeve adjoining the ejection tube at an end opposite from the ejection end; and a propellant chamber for holding a pressurized propellant, wherein the propellant chamber surrounds at least a portion of the medium chamber in a region of the sleeve, wherein the sleeve is designed for movement between a pressure position and an ejection position, wherein the sleeve, in the pressure position, is in sealing contact with the end plate and seals the medium chamber from the pressurized propellant in the propellant chamber, and wherein the sleeve, in the ejection position, is spaced apart from the end plate such that there is a fluidic path between the end plate and the sleeve that allows for passage of the pressurized propellant from the propellant chamber into the medium chamber.

2. The device according to claim 1, wherein the sleeve has a collar region which surrounds a region of the ejection tube.

3. The device according to claim 2, wherein the collar region is arranged between the propellant chamber and a pressure chamber, the pressure chamber being designed to hold a pressurized fluid, such that the sleeve is pressed against the end plate by the pressure in the pressure chamber.

4. The device according to claim 3, wherein the collar region has a first end face facing the pressure chamber and a second end face which is smaller than the first end face and which faces the propellant chamber.

5. The device according to claim 3, wherein the collar region is provided with at least one non-return valve designed for passage of propellant from the pressure chamber to the propellant chamber.

6. The device according to claim 2, wherein the sleeve has a shoulder on an inner side adjacent the collar region, where an inner cross section of the sleeve is substantially equal to an inner cross section of the ejection tube.

7. The device according to claim 6, wherein the shoulder is formed by a projection and the inner cross section of the sleeve widens towards the end plate in part of the sleeve.

8. A hand-held device, comprising:

a device for impulse ejection of a medium, the device comprising:

an ejection tube;

a medium chamber for holding the medium, the medium chamber being defined by a sleeve and including an ejection end, the sleeve adjoining the ejection tube at an end opposite from the ejection end; and a propellant chamber for holding a propellant, wherein the propellant chamber surrounds at least a portion of the medium chamber in a region of the sleeve, wherein the sleeve is designed for movement between a pressure position and an ejection position, wherein the sleeve, in the pressure position, is in sealing contact with an end plate and seals the medium chamber from pressurized propellant from the propellant chamber at the end plate, and wherein the sleeve, in the ejection position, is spaced apart from the end plate such that there is a fluidic path between the end plate and the sleeve that allows for passage of the propellant from the propellant chamber into the medium chamber, a release handle attached to the device for holding the hand-held device with one hand of a user and for triggering the impulse ejection, and a grip attached to the device for holding the hand-held device with the other hand of the user, wherein at least one of the grip or the release handle are designed to rotate about an axis parallel to a direction of impulse ejection.

9. The device according to claim 1, wherein the device is configured to eject the medium from the medium chamber at the ejection end of the ejection tube.

10. A device for impulse ejection of a medium, comprising:

an ejection tube;

a medium chamber for holding the medium, the medium chamber being defined by a sleeve and including an ejection end, the sleeve adjoining the ejection tube at an end opposite from the ejection end; and a propellant chamber for holding a propellant, the propellant chamber at least partially surrounding the medium chamber in a region of the sleeve, wherein the sleeve is designed for movement between a pressure position and an ejection position, wherein the sleeve seals, in the pressure position, the medium chamber from the propellant chamber at an end plate, and wherein the sleeve, in the ejection position, is spaced apart from the end plate such that there is fluid communication for passage of the propellant from the propellant chamber into the medium chamber, wherein the sleeve has a collar region which surrounds a region of the ejection tube, wherein the collar region is arranged between the propellant chamber and a pressure chamber, the pressure chamber being designed to hold a pressurized fluid, such that the sleeve is pressed against the end plate by the pressure in the pressure chamber, and wherein the collar region is provided with at least one non-return valve designed for passage of propellant from the pressure chamber to the propellant chamber.

* * * * *